United States Patent [19]

Clark

[11] 4,015,302

[45] Apr. 5, 1977

[54] EXPANSION JOINTS

[75] Inventor: Michael Nicholson Clark, Taunton, England

[73] Assignee: Secretary of State for Environment in Her Britannic Majesty's Government of the United Kingdom of Great Britain and Northern Ireland, London, England

[22] Filed: May 9, 1975

[21] Appl. No.: 576,120

[30] Foreign Application Priority Data

May 10, 1974 United Kingdom ..... 20901/74

[52] U.S. Cl. ..... 14/16.5; 404/47; 404/69

[51] Int. Cl.[2] ..... E01D 19/06

[58] Field of Search ..... 14/16 J; 404/48, 47; 52/59, 60, 62, 573

[56] References Cited

UNITED STATES PATENTS

| | | | |
|---|---|---|---|
| 1,637,480 | 8/1927 | Gage | 404/47 |
| 2,472,081 | 6/1949 | Kantor | 404/47 |
| 3,135,176 | 6/1964 | Foulger | 404/47 |
| 3,210,902 | 10/1965 | Craig | 52/573 X |
| 3,316,574 | 5/1967 | Pare | 404/47 X |
| 3,324,774 | 6/1967 | Boschi | 404/47 |
| 3,474,625 | 10/1969 | Draper | 404/47 X |
| 3,694,976 | 10/1972 | Warshaw | 52/573 X |
| 3,745,726 | 7/1973 | Thom | 404/47 X |

FOREIGN PATENTS OR APPLICATIONS

| | | | |
|---|---|---|---|
| 439,663 | 1967 | Switzerland | 52/60 |

*Primary Examiner*—Nile C. Byers
*Attorney, Agent, or Firm*—Cameron, Kerkam, Sutton, Stowell & Stowell

[57] ABSTRACT

A buried expansion joint for use in the construction of bridges incorporates a pad of flexible plastics material, such as neoprene, located over an expansion gap between structural members and a flashing of neoprene or other plastics material extending over the pad and stuck to the structural members by adhesive bedding. The pad may have channels or voids extending along its transverse dimension adjacent its edges which in conjunction with aligned grooves in its upper and lower surface provide a corrugated web section allowing compression longitudinally of the structural members without any substantial increase in vertical compressibility.

13 Claims, 1 Drawing Figure

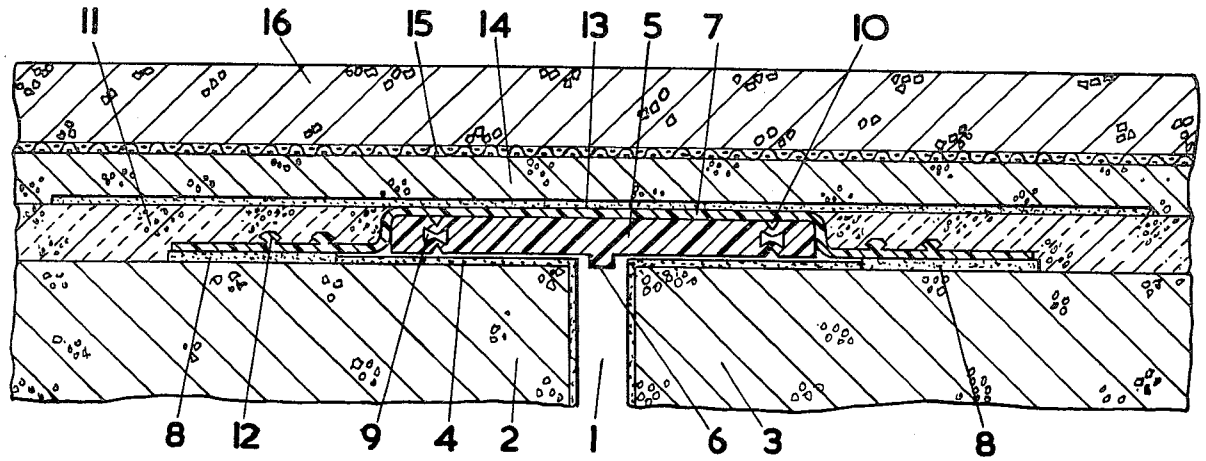
10
7
5
13
14
15
16
11
8
3
6
1
2
4
9
12
8

EXPANSION JOINTS

This invention relates to expansion joints such as are used in building construction and is concerned with a joint intended mainly for use in bridges although it is to be understood that the invention is not limited to such application.

A common form of buried expansion joint in present use for bridges comprises essentially a metal plate extending across an expansion gap formed between adjacent structural members, its upper surface being substantially flush with a first stratum of the carriageway surfacing which stratum may, for example, be of asphalt. The remaining strata of the carriageway are laid over the plate which is first covered with a debonding layer to permit relative movement between the surfacing and the plate during expansion or contraction in the region of the joint. To accommodate relative lengthwise movement a compressible material such as a putty is interposed between the edges of the plate and the adjacent edges of the first stratum of the surfacing.

Such joints have certain disadvantages. Firstly the metal plates are expensive and the joints are costly to construct. Furthermore owing to the rigidity of the plates they will tend to rock if laid on the slab surfaces and it is normally necessary to incorporate an under layer of bedding material. Metal plates are also subject to serious corrosion. The lengthwise dimension of the compressible material must be substantial in order to cope with the degree of expansion which occurs and this leaves a significant portion of the upper strata of the carriageway effectively unsupported which may lead to the formation of cracks.

With the object of avoiding the above difficulties the present invention provides an expansion joint comprising a pad of flexible plastics material located over a gap formed between adjacent structural members and a flashing of flexible plastics materials extending over said pad and attached to the said structural members.

It is highly desirable that the pad be provided, near its transverse edges, with weakened sections arranged to provide compressibility longitudinally of the structure in which it is incorporated without substantially increasing its vertical compressibility. Such sections can conveniently be formed by the incorporation, within the pad adjacent the said edges, of voids or channels which may be vertically aligned with grooves in the upper and lower surfaces to provide a web section connecting the edge portions of the pad to the main centre portion. In a preferred arrangement the grooves and the corresponding upper and lower boundaries of the channels are of V shape so that the webs take the form of a corrugation. Pads of suitable form can conveniently be produced by extrusion.

Neoprene is a particularly suitable material for both the pad and the flashing. It is desirable that an anti-friction layer should be inserted between the pad and the structural members particularly when these are of a rough material such as concrete. This layer may conveniently be an aluminium faced adhesive sheet which is stuck to the structural members and presents a smooth upper face to the contacting lower surface of the pad. It is also advantageous to include, above the joint, a debonding layer before constructing any surfacing layers over the joint in order that the tension in any such upper layers may be spread over a greater length thus reducing liability to cracking.

A buried expansion joint in accordance with the invention and intended for use in construction of a bridge will now be more particularly described with reference to the accompanying drawing.

The single FIGURE of the drawing is a transverse cross section of a bridge joint in accordance with the invention.

An expansion gap 1 is formed between adjacent concrete structural members 2, 3. Covering the upper surfaces of members 2, 3 in the vicinity of the gap 1 and extending over their edges into the gap are sheets 4 of aluminium faced adhesive material stuck to the members with its metal face outward. Spanning the gap 1 is a pad 5 of neoprene located in position by a rib 6 which extends into the gap.

The sheets 4 form an anti-friction layer between the pad and the members 2, 3. A flashing 7, also of neoprene, extends over the upper surface of the pad 5 and down its sides and finally along the surface of the structural members 2, 3 to which it is attached by layers of adhesive bedding 8. The pad 5 has shaped voids 9 near its ends aligned vertically with grooves 10 in its upper and lower surfaces to permit longitudinal but not vertical compression. The neoprene flashing 7 caters for tension movements and also provides a waterproof cover over the expansion gap.

A waterproofing layer 11, comprising for example mastic asphalt laid up to the shoulders of the flashing 7, or a waterproof membrane covered with a protective medium may be inserted on one or both sides of the joint. In some cases this waterproofing layer may be keyed to the flashing as shown at 12. A debonding layer 13 of aluminium faced sheet is laid above the joint and extends for some distance on either side thereof to spread any extension over a considerable length of the surfacing. A base course 14 extends continuously over the waterproofing layer 11 and the debonding layer 13, and the carriageway is completed by two further layers; firstly an embedded layer of expanded metal 15 or other suitable reinforcing material and finally a wearing course 16 which constitutes the road surface.

It will be appreciated that the materials mentioned herein may be replaced by other suitable materials, for example, although neoprene is considered eminently suitable for the pad and flashing, other materials could be used instead, the main requirements being a proper degree of flexibility and durability. It will be further understood that such a joint may find application in a variety of building structures and is not limited to use in bridges.

I claim:

1. A buried expansion joint for use in the construction of a bridge having a pair of spaced structural members each covered with a waterproofing layer and surmounted by a roadway, said expansion joint comprising a pad of flexible plastics material located over the gap formed between said structural members, and a flashing of flexible plastics material extending in a direction transverse of the gap over the said pad and downwardly at the two sides of the pad and then outwardly along the surface of said structural members, the outwardly extending edge portions of said flashing lying beneath said waterproofing layers, said edge portions having means attaching said edge portions to said waterproofing layers.

2. An expansion joint as claimed in claim 1 wherein the said pad has formed therein, weakened sections along edges extending transversely of the structural members to provide compressibility longitudinally of said structural members without substantially increasing the vertical compressibility of the pad.

3. An expansion joint as claimed in claim 2 wherein the said weakened sections comprise web sections connecting edge portions of the pad to its main centre portion and formed by the provision of voids within the pad along and adjacent the said edges which voids are aligned vertically with grooves formed in the upper and lower surfaces of the pad.

4. An expansion joint as claimed in claim 3 wherein the said grooves and the corresponding boundaries of the voids are of similar V shape whereby the web sections take the form of corrugations.

5. An expansion joint as claimed in claim 1 wherein the pad is made of neoprene.

6. An expansion joint as claimed in claim 1 wherein the flashing is made of neoprene.

7. An expansion joint as claimed in claim 1 incorporating an anti-friction layer inserted between the pad and the structural members.

8. An expansion joint as claimed in claim 7 wherein the anti-friction layer comprises an aluminium faced adhesive sheet which is stuck to the structural members and has a smooth upper surface in contact with the lower face of the pad.

9. An expansion joint as claimed in claim 1 incorporating a debonding layer extending over the flashing.

10. An expansion joint as claimed in claim 1 incorporating layers of adhesive bedding beneath the edge portions of the flashing to attach the flashing to the structural members.

11. An expansion joint as claimed in claim 1 wherein the waterproofing layer is of mastic asphalt.

12. An expansion joint as claimed in claim 1 wherein the waterproofing layer comprises a waterproof membrane and a protective medium covering said membrane.

13. An expansion joint as claimed in claim 1 wherein the flashing has projections formed upon its upper surface and embedded in the waterproofing layer to key the flashing thereto.

* * * * *